US009325098B2

(12) United States Patent
Chen et al.

(10) Patent No.: US 9,325,098 B2
(45) Date of Patent: Apr. 26, 2016

(54) POWER CONNECTOR

(71) Applicant: DELTA ELECTRONICS, INC., Taoyuan County (TW)

(72) Inventors: Chun-Chen Chen, Taoyuan County (TW); Jui-Ting Hsu, Taoyuan County (TW)

(73) Assignee: DELTA ELECTRONICS, INC. (TW)

( * ) Notice: Subject to any disclaimer, the term of this patent is extended or adjusted under 35 U.S.C. 154(b) by 0 days.

(21) Appl. No.: 14/705,436

(22) Filed: May 6, 2015

(65) Prior Publication Data

US 2016/0093969 A1 Mar. 31, 2016

(30) Foreign Application Priority Data

Sep. 30, 2014 (TW) ..... 103133851 A

(51) Int. Cl.
*H01R 13/44* (2006.01)

(52) U.S. Cl.
CPC ..... *H01R 13/44* (2013.01)

(58) Field of Classification Search
CPC ..... H01R 13/447; H01R 35/04; H01R 31/06; H01R 13/60
USPC ..... 439/131, 136, 172
See application file for complete search history.

(56) References Cited

U.S. PATENT DOCUMENTS 4,519,015 A * 5/1985 Lin ..... H05K 5/069 336/107
6,312,271 B1 * 11/2001 Tseng ..... H01R 13/44 439/131
6,592,406 B2 * 7/2003 Liu ..... H01R 13/6641 439/172
7,125,266 B1 * 10/2006 Huang ..... H01R 35/04 439/131
7,344,385 B2 * 3/2008 Chen ..... H05K 3/32 439/131
7,354,286 B1 * 4/2008 Lee ..... H01R 13/652 439/131
7,787,238 B2 * 8/2010 Liao ..... H01R 31/065 439/131
7,798,825 B1 * 9/2010 Pai ..... H01R 31/06 439/131
8,790,124 B2 * 7/2014 Lee ..... H01R 31/06 439/131
2003/0076070 A1 4/2003 Wang et al.
2006/0110963 A1 * 5/2006 Cheng ..... H01R 13/6675 439/171
2013/0288493 A1 * 10/2013 Shi ..... H01R 31/06 439/131
2013/0316553 A1 * 11/2013 Lee ..... H01R 35/04 439/131

FOREIGN PATENT DOCUMENTS

JP 2003-132990 5/2003

OTHER PUBLICATIONS

Office Action dated Jan. 19, 2016 from corresponding No. JP 2015-084076.

* cited by examiner

*Primary Examiner* — Briggitte R Hammond
(74) *Attorney, Agent, or Firm* — Hauptman Ham, LLP

(57) ABSTRACT

A power connector includes an insulating base, a pair of rotating seats, a pair of terminals and a pair of electrodes. Each rotating seat is pivotally installed to the insulating base. The terminals are parallel to each other and disposed with an interval apart on each respective rotating seat, such that the terminals may be rotated with respect to the insulating base and selectively to an extended position and a retracted position. The electrodes are installed to the insulating base and configured to be corresponsive to the terminals respectively. A pair of grippers are extended from each electrode, such that when the terminals are rotated, the grippers clamp the respect terminal to maintain an electric connection with the terminal continuously.

15 Claims, 9 Drawing Sheets

POWER CONNECTOR

FIELD OF THE INVENTION

The present invention relates to a power connector, and more particularly to the power connector with continuously and electrically connected terminals.

BACKGROUND OF THE INVENTION

In general, a conventional power connector is designed integrally with a transformer (or an adapter), and most terminals of the power connector come with a rotary design, and a casing with an accommodating space, so that the terminals may be rotated and stored into the accommodating space. In the design of the conventional power connector, the terminal includes a flange disposed in the casing, and the casing includes an electrode configured to be corresponsive to the flange. When the terminals are extended from the accommodating space to the outside, the flange will be abutted and electrically connected. When the terminals are retracted into the accommodating space, the terminals are separated from electrodes and electrically disconnected. Therefore, when the power connector is loosened and separated, the terminals are rotated to cause an electrical disconnection, and sparks will be produced at the moment when the terminals are contacted and electrically connected to the electrodes.

In view of the aforementioned problems of the prior art, the inventor of the present invention based on years of experience in the related industry to conduct extensive researches and experiments and provide a feasible solution in accordance with the present invention to overcome the problems of the prior art.

SUMMARY OF THE INVENTION

Therefore, it is a primary objective of the present invention to provide a power connector with continuously and electrically connected terminals.

To achieve the aforementioned objective, the present invention provides a power connector, comprising an insulating base, a pair of rotating seats, a pair of terminals and a pair of electrodes. The rotating seats are pivotally installed to the insulating base. The terminals are parallel to each other and disposed with an interval apart from each other at each respective rotating seat, so that the terminals may be selectively rotated to an extended position and a retracted position with respect to the insulating base. The electrode includes an insulating base disposed at a position corresponsive to the terminal, and each electrode has a pair of grippers extended to the outside, such that when the terminal is rotated, the grippers can clamp the terminal continuously.

Preferably, a cam is formed at an end of each terminal, and the grippers can clamp the cam continuously. Preferably, an elastic plate is extended from each electrode, such that when the terminal is situated at the retracted position, the terminal and the elastic plate are separated from each other; and when the terminal is situated at the extended position, each terminal abuts the respective elastic plate. Preferably, a flange is extended from each terminal, such that when the terminal is situated at the extended position, each flange abuts the respective elastic plate. Preferably, the flange and cam of each terminal are installed and connected next to each other. Preferably, the curvature of each extended cam is not less than 90 degrees.

The present invention further provides a power connector comprising: an insulating base; a pair of terminals; and a pair of electrodes. The terminals are installed with an interval apart and parallel to each other, and respectively and pivotally coupled to the insulating base. The electrodes are configured to be corresponsive to the pair of terminals respectively and installed to the insulating base. A pair of grippers are extended from each electrode, and the grippers are in contact with the terminals to form an electric connection, such that when the pair of terminals are rotated, the pair of grippers clamp the terminal to maintain the electric connection continuously.

Preferably, each terminal has a cam formed at an end thereof, and the pair of grippers clamp the cam continuously. Each electrode has an elastic plate extended therefrom, such that when the pair of terminals are situated at a retracted position, the terminals and the elastic plates are separated from each other respectively, and when the pair of terminals are situated at an extended position, each terminal abuts the respective elastic plate. Each terminal has a flange extended therefrom, such that when the pair of terminals are situated at the extended position, each flange abuts the respective elastic plate. The flange and the cam of each terminal are installed and connected next to each other. Each cam is extended with a curvature not less than 90 degrees.

The present invention further provides a power connector comprising an insulating base, and the insulating base further comprises a pair of terminals and a pair of electrodes. The terminals and the electrode are configured to be corresponsive to each other respectively, and each electrode has a pair of grippers extended therefrom and contacted with the pair of terminals respectively to produce an electric connection, such that when the pair of terminals are rotated, the pair of grippers clamp the terminals to maintain the electric connection continuously.

Preferably, a cam is formed at an end of each terminal, and the electrode is in contact with the cam continuously. Preferably, each electrode has an elastic plate extended therefrom, each terminal has a flange extended therefrom, such that when the terminal is situated at the extended position, and each flange abuts the respective elastic plate. Preferably, the flange and the cam of each terminal are installed and connected next to each other. Each cam is extended with a curvature preferably not less than 90 degrees.

In the power connector of the present invention, the electrode has the grippers to clamp the terminals to maintain the electric connection, so that the terminals will not be electrically disconnected during the rotation, and there will be no issue of producing the sparks during the electric connection.

DESCRIPTION OF THE PREFERRED EMBODIMENTS

Figure 1:
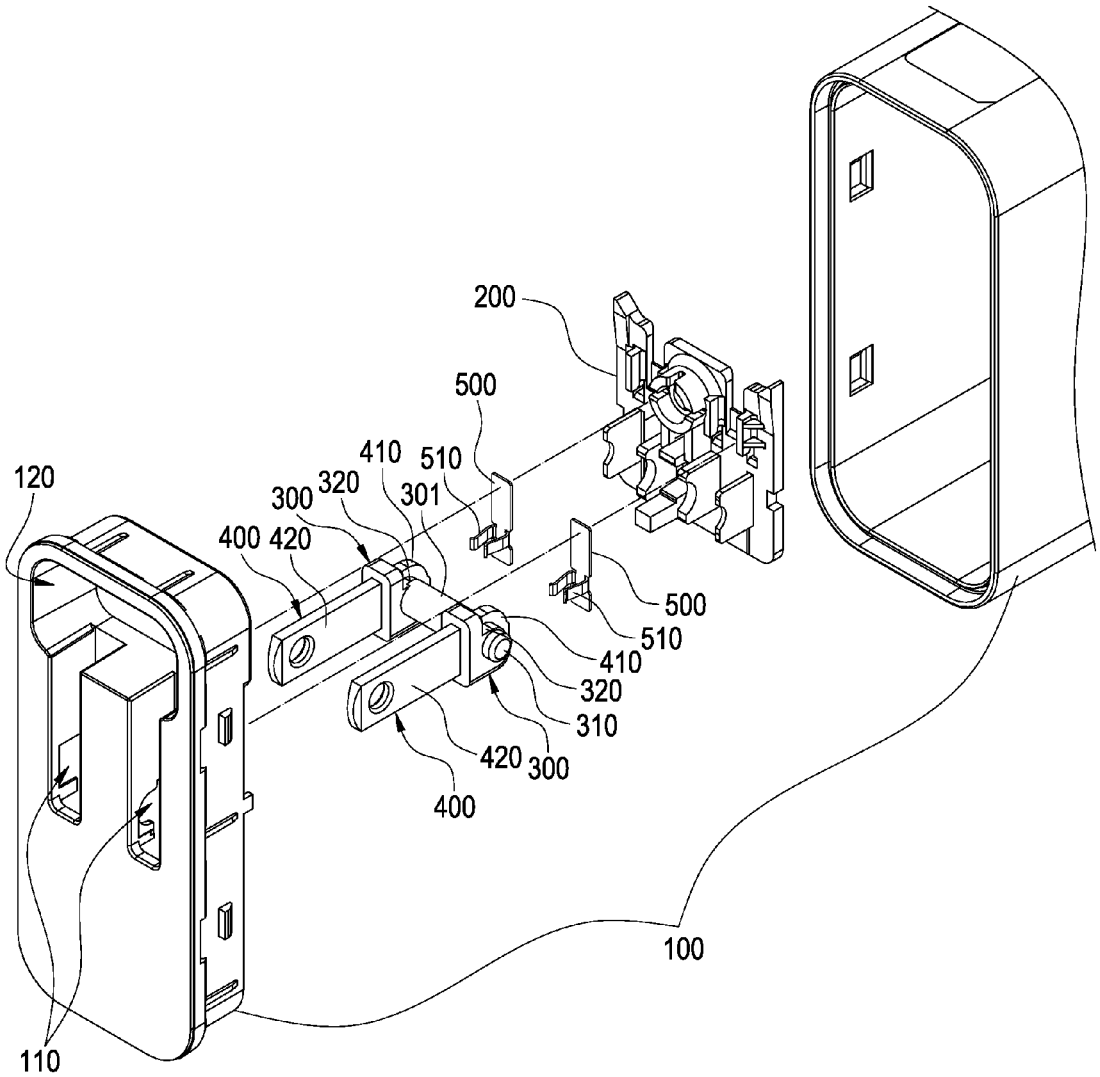
FIG. 1 is an exploded view of a power connector in accordance with a first preferred embodiment of the present invention.

The technical contents of the present invention will become apparent with the detailed description of a preferred embodiment accompanied with the illustration of related drawings as follows. It is noteworthy that same numerals are used for representing same respective elements in the drawings.

Figure 2:
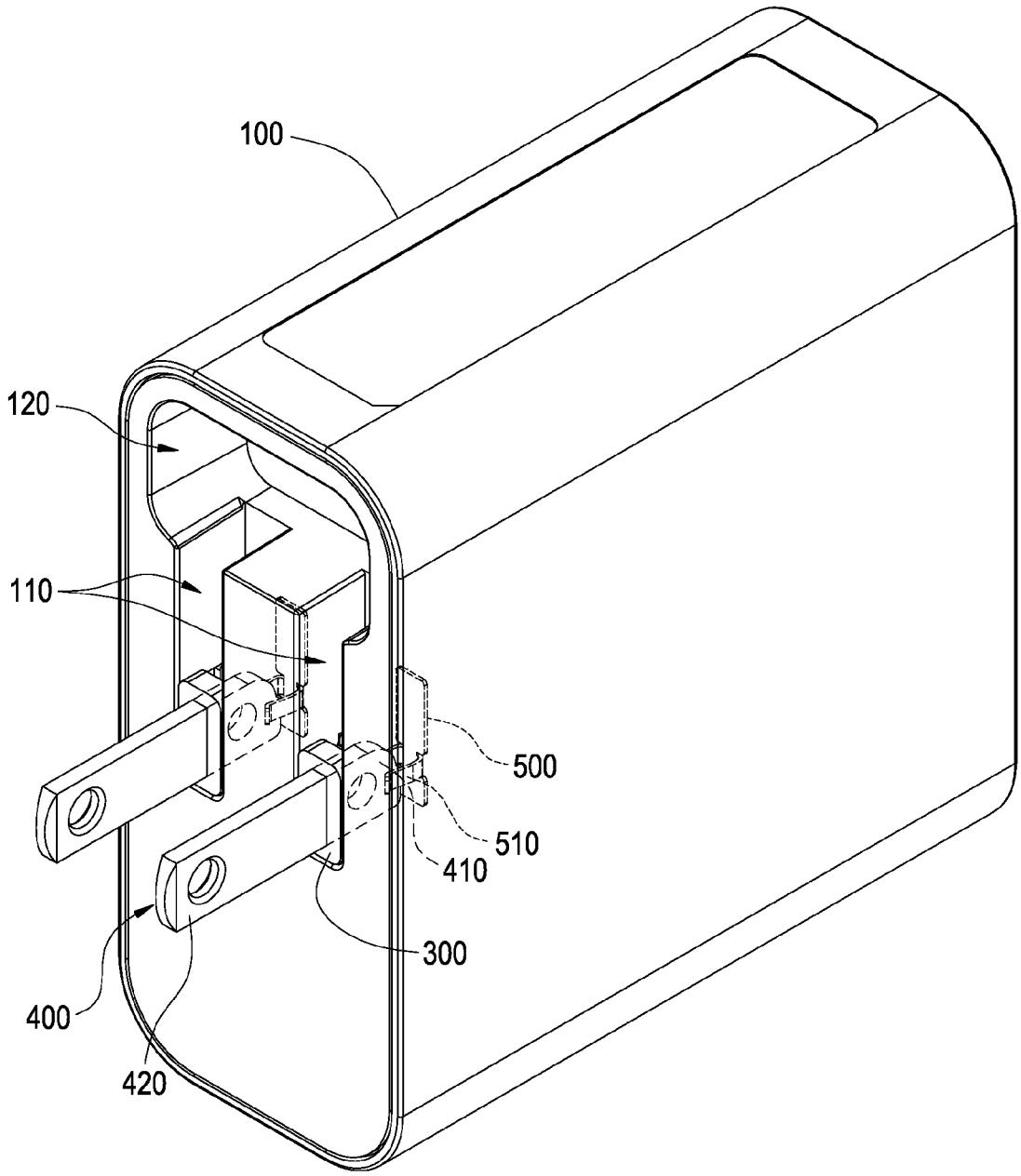
FIG. 2 is a perspective view of a power connector in accordance with the first preferred embodiment of the present invention.
Figure 3:
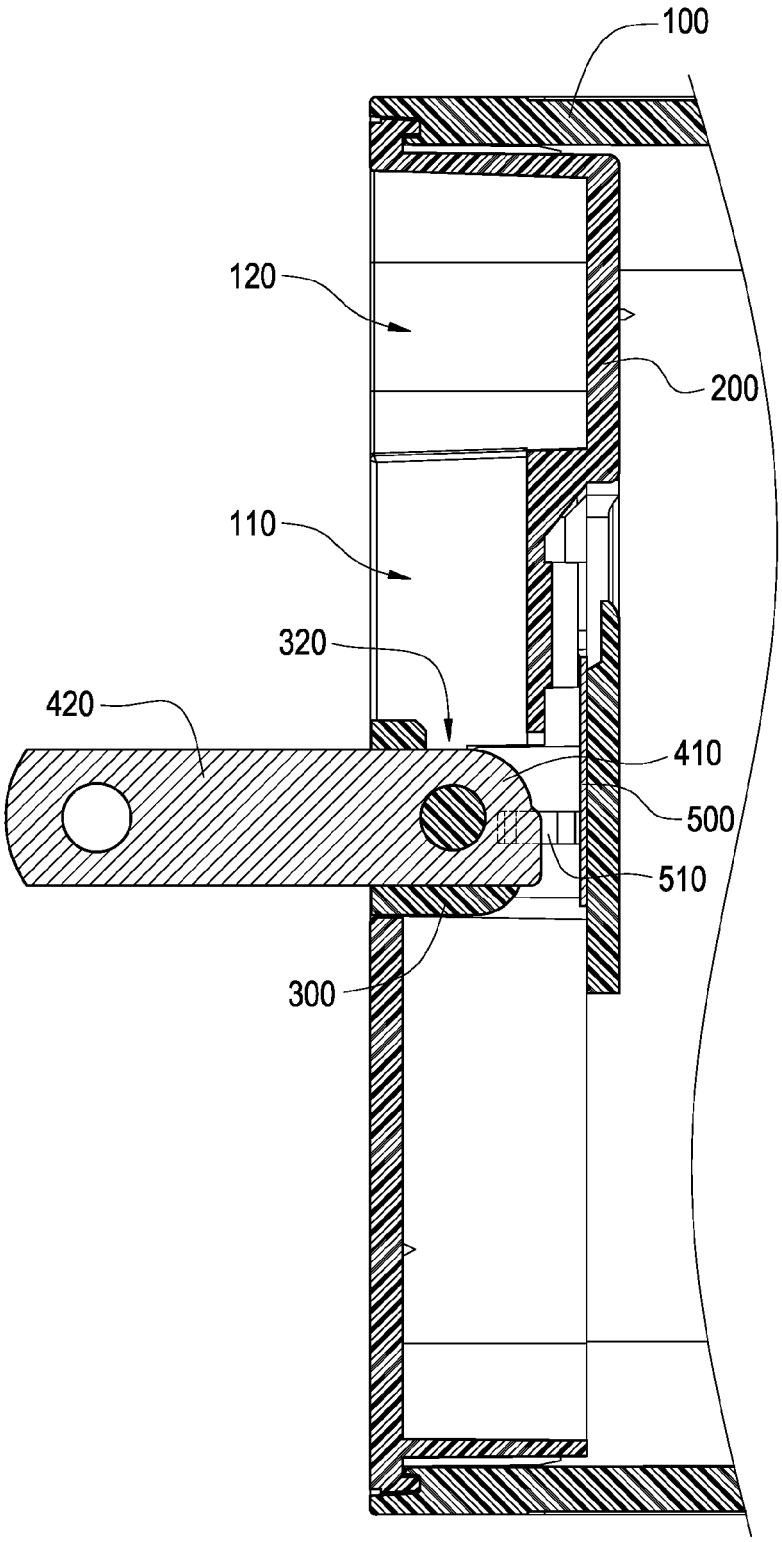
FIG. 3 is a schematic view of a power connector with an outwardly extended terminal in accordance with the first preferred embodiment of the present invention.
Figure 4:
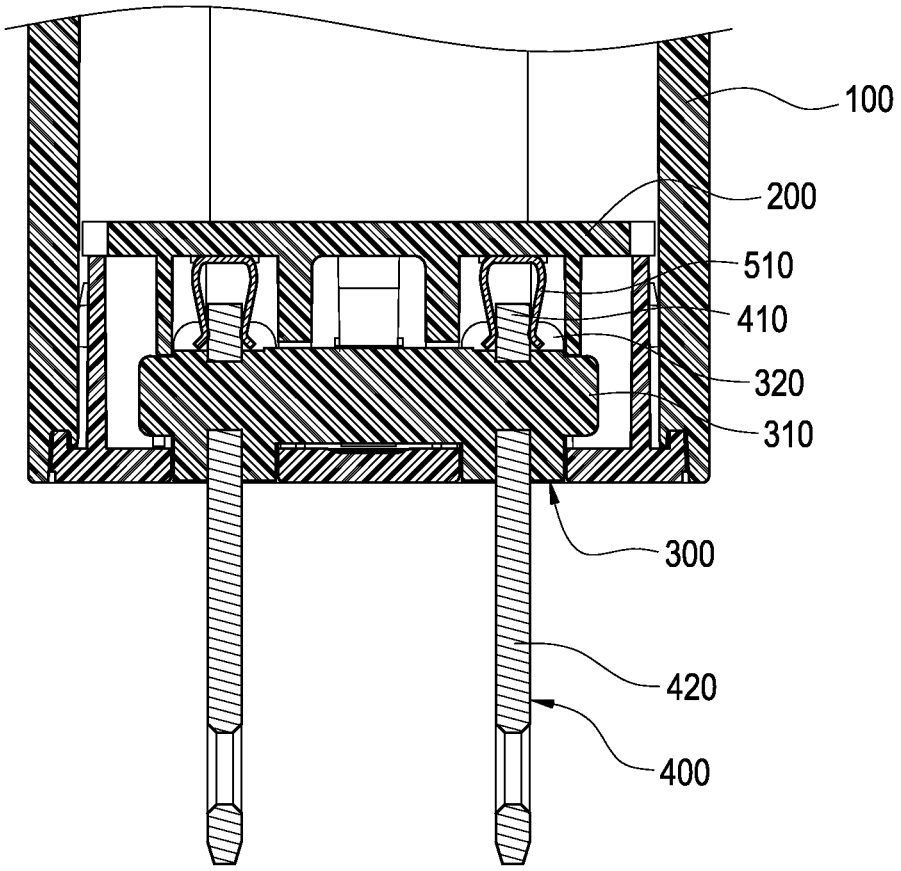
FIG. 4 is another schematic view of a power connector with an outwardly extended terminal in accordance with the first preferred embodiment of the present invention.
Figure 5:
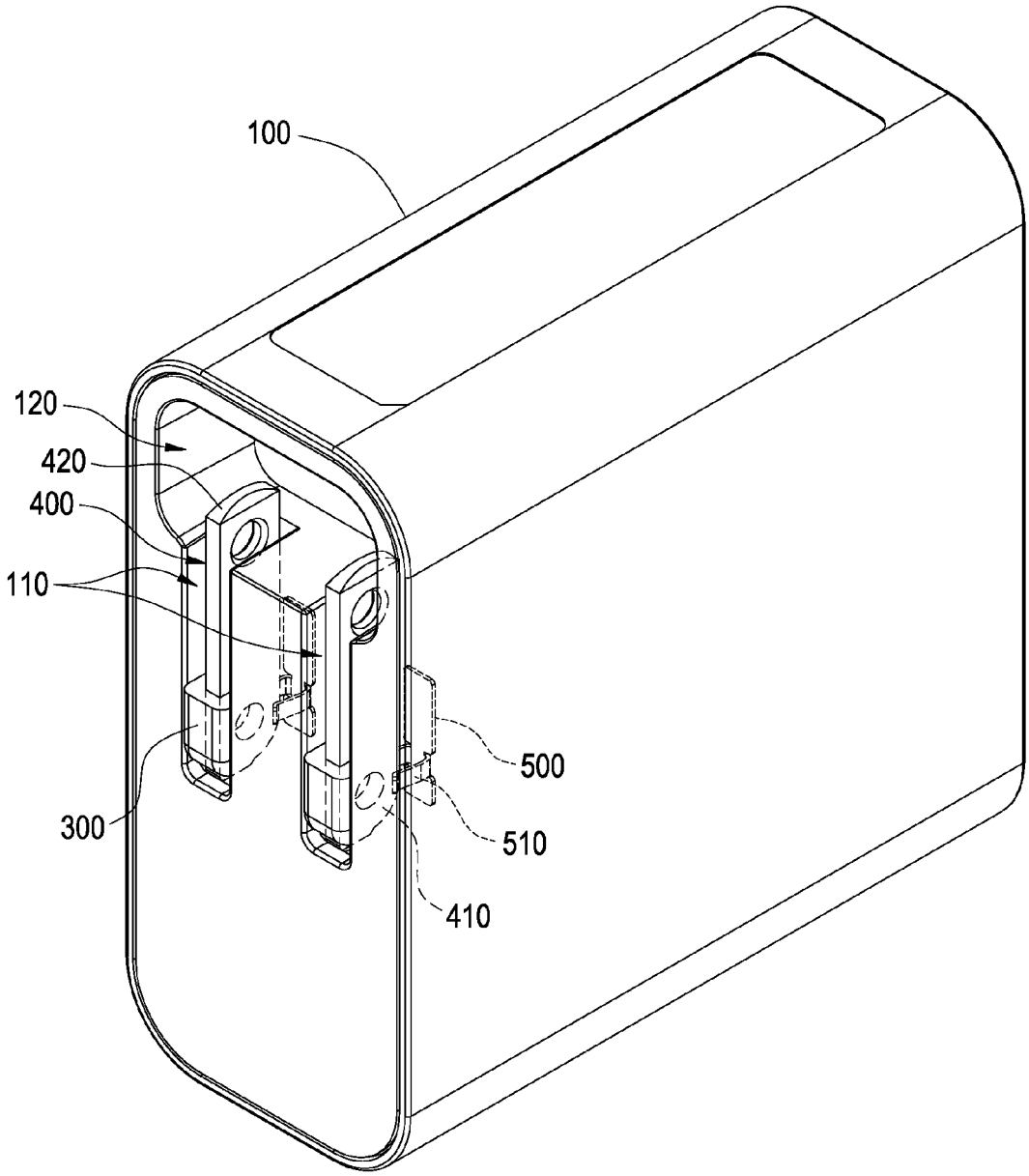
FIG. 5 is a schematic view of a power connector with a retracted terminal in accordance with the first preferred embodiment of the present invention.
Figure 6:
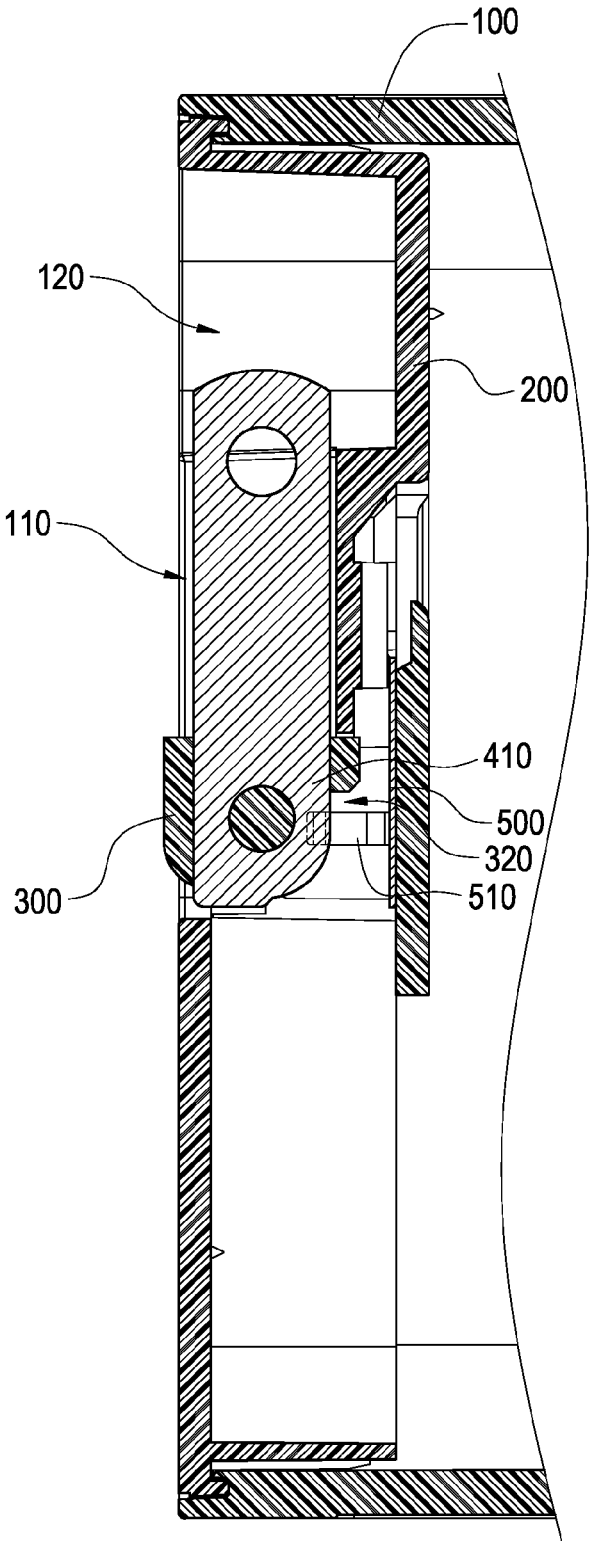
FIG. 6 is another schematic view of a power connector with a retracted terminal in accordance with the first preferred embodiment of the present invention.

With reference to FIGS. 1 and 2 for a power connector of the first preferred embodiment of the present invention, the power connector comprises a casing 100, an insulating base 200, a pair of rotating seats 300, a pair of terminals 400, and a pair of electrodes 500.

In this embodiment, the casing 100 is preferably an insulating casing made of plastic. The casing 100 has a pair of accommodating slots 110 formed on an external surface of the casing 100 and a connecting slot 120 formed and coupled between the pair of accommodating slots 110. In this embodiment, both ends coupled to the connecting slot 120 are preferably interconnected to an end of the accommodating slot 110.

In this embodiment, the insulating base 200 is preferably a base made of plastic, and the insulating base 200 is preferably installed in the casing 100.

In this embodiment, each rotating seat 300 is preferably a seat made of plastic, and each rotating seat 300 includes a protruding shaft 310 protruded therefrom and a notch 320 formed on each rotating seat 300. Each rotating seat 300 is pivotally coupled to insulating base 200 through the protruding shaft 310, and a connecting rod 301 is coupled between the pair of rotating seats 300 for linking and rotating the pair of rotating seats 300.

With reference to FIGS. 3 to 6, the pair of terminals 400 are disposed with an interval apart and parallel to each other, and each terminal 400 is installed at each respective rotating seat 300, and capable of rotating with respective to the insulating base 200 by the rotating seat 300 and selectively to an extended position and a retracted position. In this embodiment, each terminal 400 is a long metal strip, and a middle section of each terminal 400 is buried into the respective rotating seat 300, and a cam 410 is formed at an end of each terminal 400, and an insert 420 is formed at the other end of each terminal 400 for plugging into a Mains socket. Each cam 410 is extended with a curvature not less than 90 degrees, and each cam 410 is exposed from each respective notch 320. Each terminal 400 is passed through the other end of each accommodating slot 110 and out of the casing 100. When the pair of terminals 400 are situated at the retracted position, each insert 420 is accommodated in each respective accommodating slot 110, and an end of the insert 420 is exposed from the connecting slot 120 to facilitate users to pull out the insert 420. When the pair of terminals 400 are situated at the extended position, each insert 420 is protruded from the casing 100. Preferably, the insert 420 situated at the extended position is perpendicular to the insert 420 situated at the retracted position.

In this embodiment, each electrode 500 is a long metal strip, and each electrode 500 is configured to be corresponsive to each respective terminal 400 and installed to the insulating base 200, and a pair of grippers 510 are extended from both sides of each electrode 500 and contacted with the terminals 400 respectively to produce an electric connection. When the terminals 400 are rotated, the grippers 510 clamp the cam 410 continuously to maintain the electric connection between the terminals 400 and the electrodes 500 continuously.

Figure 7:
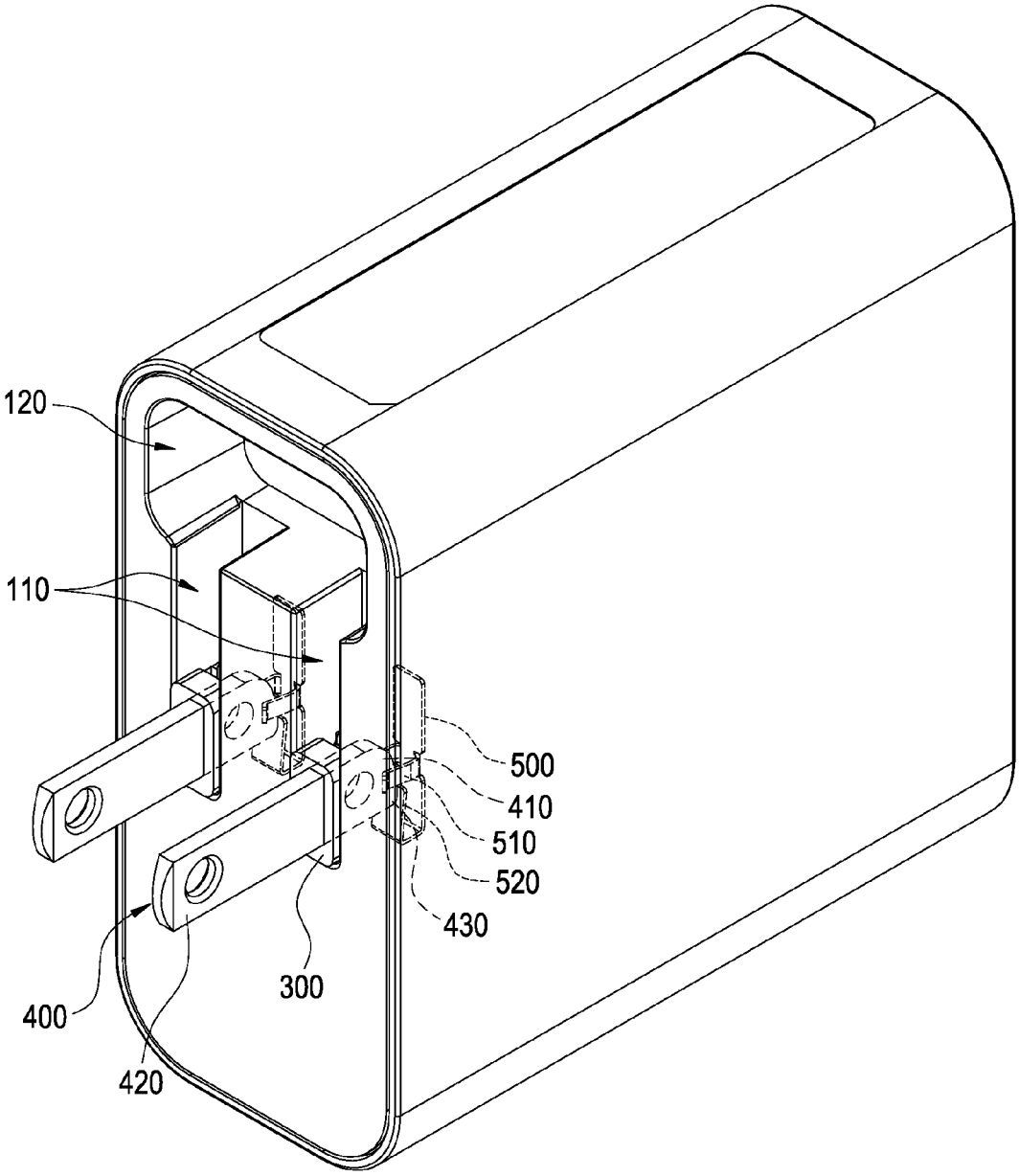
FIG. 7 is a perspective view of a power connector in accordance with a second preferred embodiment of the present invention.
Figure 8:
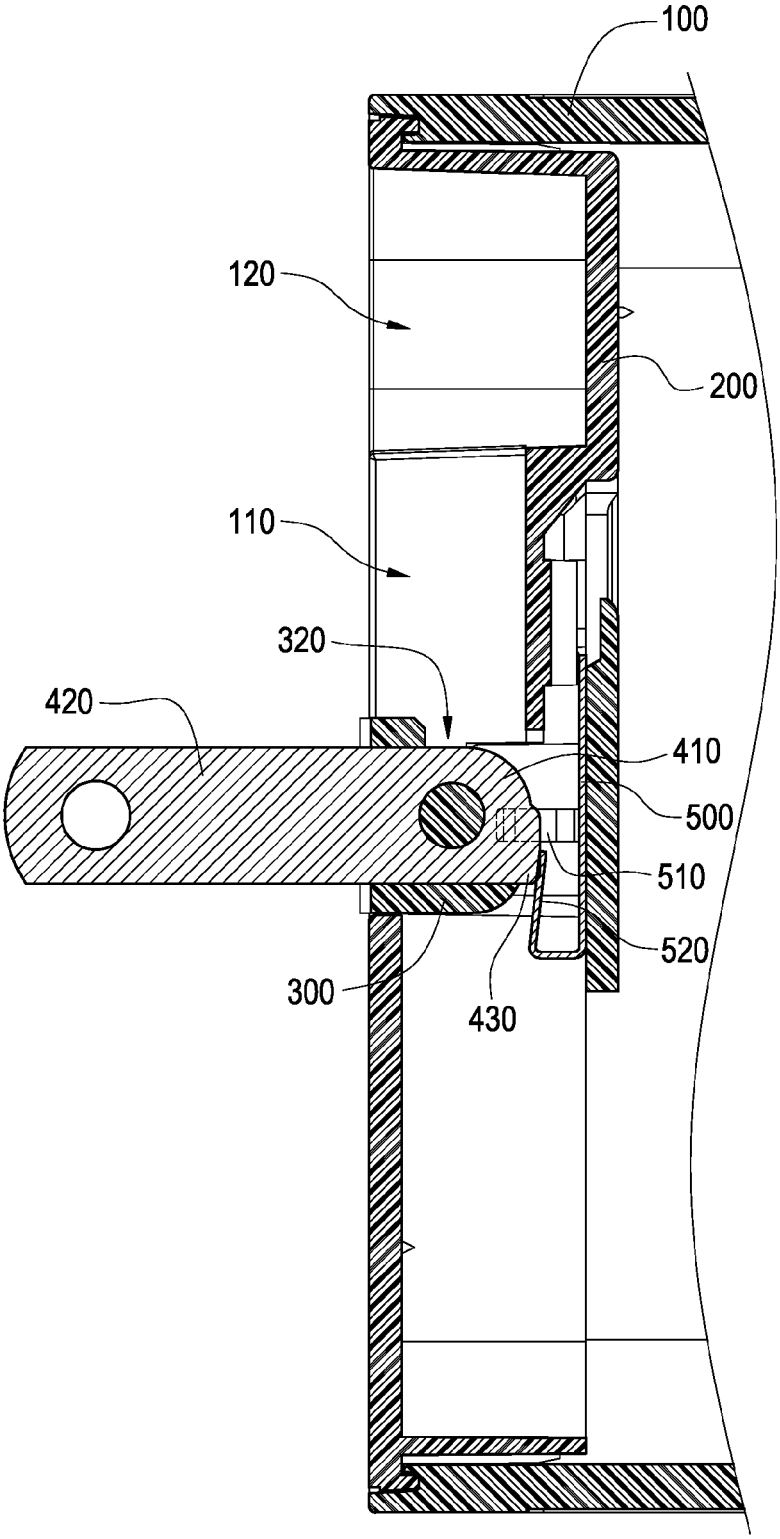
FIG. 8 is a schematic view of a power connector with an outwardly extended terminal in accordance with the second preferred embodiment of the present invention.
Figure 9:
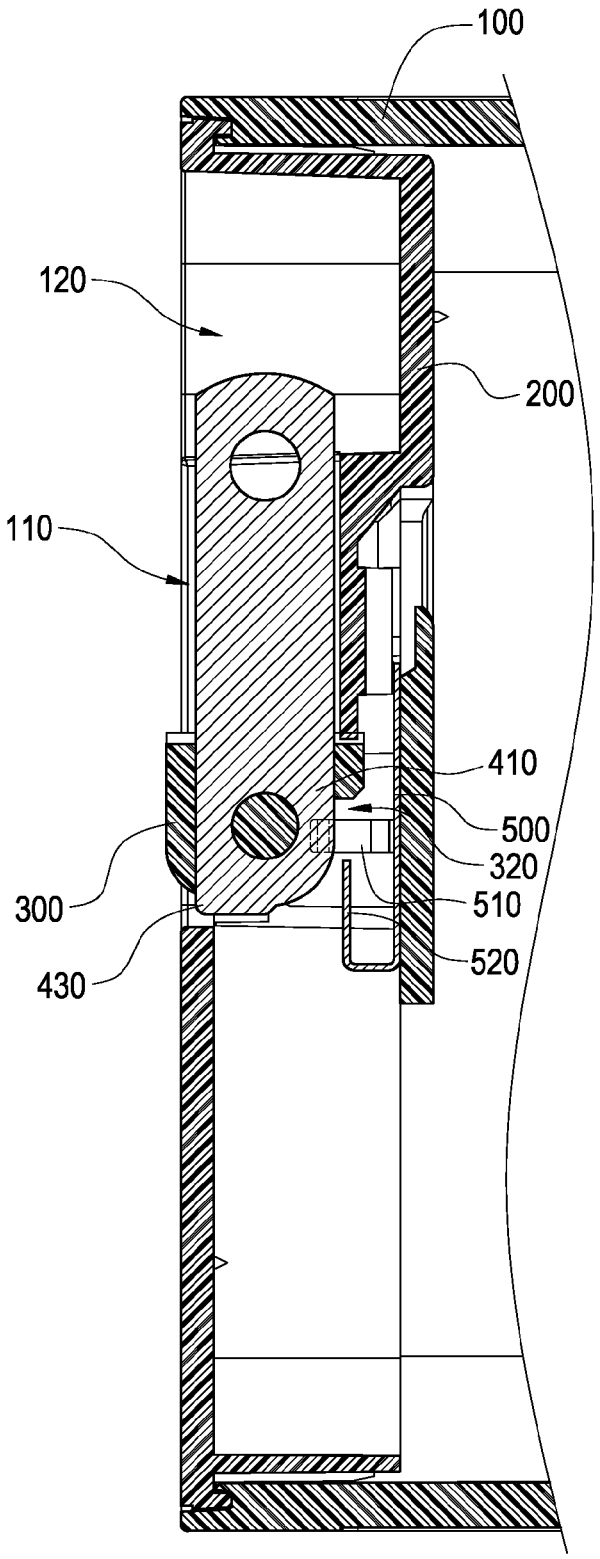
FIG. 9 is a schematic view of a power connector with a retracted terminal in accordance with the second preferred embodiment of the present invention.

With reference to FIGS. 7 to 9 for a power connector in accordance with the second preferred embodiment of the present invention, the power connector comprises a casing 100, an insulating base 200, a pair of rotating seats 300, a pair of terminals 400 and a pair of electrodes 500.

In this embodiment, the casing 100 is preferably an insulating casing made of plastic. The casing 100 includes a pair of accommodating slots 110 formed on an external surface of the casing 100 and a connecting slot 120 coupled between the pair of accommodating slots 110. In this embodiment, both ends coupled to the connecting slot 120 are preferably interconnected to an end of each accommodating slot 110.

In this embodiment, the insulating base 200 is preferably a base made of plastic, and the insulating base 200 is installed in the casing 100.

In this embodiment, each rotating seat 300 is preferably a seat made of plastic, and each rotating seat 300 includes a protruding shaft 310 protruded therefrom and a notch 320 formed on the rotating seat 300. Each rotating seat 300 is pivotally coupled to the insulating base 200 through the protruding shaft 310, and a connecting rod 301 is coupled between the pair of rotating seats 300 for linking and rotating the pair of rotating seats 300.

The pair of terminals 400 are disposed with an interval apart and parallel to each other, and each terminal 400 is installed to each respective rotating seat 300 and rotated with respect to the insulating base 200 by the rotating seat 300 and selectively to an extended position and a retracted position. In this embodiment, each terminal 400 is a long metal strip, and a middle section of each terminal 400 is buried into the respective rotating seat 300, and a cam 410 is formed at an end of each terminal 400, and a flange 430 is extended from the each terminal 400. The flange 430 and the cam 410 are installed and disposed next to each other, and an insert 420 is formed at the other end of each terminal 400 for plugging into a Mains socket. Each cam 410 is extended with a curvature not less than 90 degrees and exposed from each respective notch 320. Each terminal 400 is passed through the other end of each accommodating slot 110 and out of the casing 100. When the pair of terminals 400 are situated at the retracted position, each insert 420 is accommodated in each respective accommodating slot 110, and an end of the insert 420 is exposed form the connecting slot 120 to facilitate users to pull out the insert 420. When the pair of terminals 400 are situated at the extended position, each insert 420 is protruded from the casing 100. Preferably, the insert 420 situated at the extended position is perpendicular to the insert 420 situated at the retracted position.

In this embodiment, each electrode 500 is a long metal strip, and each electrode 500 is configured to be corresponsive to each terminal 400 and installed to the insulating base 200. A pair of grippers 510 and an elastic plate 520 are formed on both sides of each electrode 500 respectively, and the grippers 510 are contacted with the terminals 400 to produce an electric connection. When the terminals 400 are rotated, the grippers 510 clamp the cam 410 to maintain the electric connection between the terminals 400 and the electrodes 500 continuously. When the terminals 400 are situated at the retracted position, the terminals 400 and the elastic plates 520 are separated from each other. When the terminals 400 are situated at the extended position, the flange 430 of each terminal 400 abuts the respective elastic plate 520 to reduce the contact resistance between the terminal 400 and the electrode 500.

In the power connector of the present invention, the electrode 500 includes the gripper 510 for clamping the cam 410 of the terminal 400, so that when the terminals 400 are rotated, the terminal 400 and the electrode 500 are maintained to be electrically connected to each other. There will be no power disconnection during the process of rotating the terminal 400 even if the power connector is loosened. There is no issue of producing sparks during the electric connection of the terminals 400 and the electrodes 500.

While the invention has been described by means of specific embodiments, numerous modifications and variations could be made thereto by those skilled in the art without departing from the scope and spirit of the invention set forth in the claims.

What is claimed is:

1. A power connector, comprising:

an insulating base;

a pair of rotating seats, respectively and pivotally installed to the insulating base;

a pair of terminals, installed with an interval apart and parallel to each other on each respective the rotating seat, and capable of rotating with respect to the insulating base and selectively to an extended position and a retracted position; and a pair of electrodes, installed at the insulating base and configure to be corresponsive to the pair of terminals respectively, and a pair of grippers being extended from each electrode, such that when the pair of terminals are rotated, the pair of grippers clamp the terminals to form an electrical connection, wherein each terminal has a cam formed at an end thereof, and the pair of grippers clamp the cam continuously.

2. The power connector of claim 1, wherein each electrode has an elastic plate extended therefrom, such that when the pair of terminals are situated at the retracted position, the terminals and the elastic plates are separated from each other respectively.

3. The power connector of claim 1, wherein each electrode has an elastic plate extended therefrom, such that when the pair of terminals are situated at the extended position, each terminal abuts the respective elastic plate.

4. The power connector of claim 3, wherein each terminal has a flange extended therefrom, such that when the pair of terminals are situated at the extended position, each flange abuts the respective elastic plate.

5. The power connector of claim 4, wherein the flange and the cam of each terminal are installed and connected next to each other.

6. The power connector of claim 1, wherein each cam is extended with a curvature not less than 90 degrees.

7. A power connector, comprising:

an insulating base;

a pair of terminals, installed with an interval apart and parallel to each other, and respectively and pivotally coupled to the insulating base; and a pair of electrodes, configured to be corresponsive to the pair of terminals and installed to the insulating base, and a pair of grippers being extended from each electrode, and the gripper being in contact with the terminal to form an electric connection, such that when the pair of terminals are rotated, the pair of grippers clamp the terminal to maintain the electric connection continuously, wherein each terminal has a cam formed at an end thereof, and the pair of grippers clamp the cam continuously.

8. The power connector of claim 7, wherein each electrode has an elastic plate extended therefrom, such that when the pair of terminals are situated at a retracted position, the terminals and the elastic plates are separated from each other respectively, and when the pair of terminals are situated at an extended position, each terminal abuts the respective elastic plate.

9. The power connector of claim 8, wherein each terminal has a flange extended therefrom, such that when the pair of terminals are situated at the extended position, each flange abuts the respective elastic plate.

10. The power connector of claim 9, wherein the flange and the cam of each terminal are installed and connected next to each other.

11. The power connector of claim 7, wherein each cam is extended with a curvature not less than 90 degrees.

12. A power connector, comprising an insulating base, and the insulating base further comprising:

a pair of terminals and a pair of electrodes, configured to be corresponsive to each other respectively, and a pair of grippers extended from the electrode and contacted with the pair of terminals respectively to form an electric connection, such that when the pair of terminals are rotated, the pair of grippers clamp the terminal to maintain the electric connection continuously, wherein each terminal has a cam formed at an end thereof, and the pair of grippers clamp the cam continuously.

13. The power connector of claim 12, wherein each electrode has an elastic plate extended therefrom, each terminal has a flange extended therefrom, such that when the pair of terminals are situated at the extended position, each flange abuts the respective elastic plate.

14. The power connector of claim 13, wherein the flange and the cam of each terminal are installed and connected next to each other.

15. The power connector of claim 12, wherein each cam is extended with a curvature not less than 90 degrees.

* * * * *